United States Patent [19]

Corbeels et al.

[11] Patent Number: 4,575,381

[45] Date of Patent: Mar. 11, 1986

[54] FORMATION OF DISPERSE-SLURRY OF COAL LIQUEFACTION RESIDUE

[75] Inventors: Roger J. Corbeels, Wappingers Falls; Stephen R. Vasconcellos, Fishkill, both of N.Y.

[73] Assignee: Texaco Inc., White Plains, N.Y.

[21] Appl. No.: 584,977

[22] Filed: Mar. 1, 1984

[51] Int. Cl.[4] ..... C10L 1/32

[52] U.S. Cl. ..... 44/51; 44/66; 44/72; 208/8 LE; 208/10

[58] Field of Search ..... 44/51, 66, 72; 208/8 LE, 10; 241/16

[56] References Cited

U.S. PATENT DOCUMENTS

| | | | |
|---|---|---|---|
| 2,221,886 | 11/1940 | Beck | 206/109 |
| 2,860,101 | 11/1958 | Pelipetz | 208/10 |
| 3,341,447 | 9/1967 | Bull et al. | 288/8 |
| 3,811,848 | 5/1974 | Johnson | 44/72 |
| 4,242,102 | 12/1980 | Snell | 208/8 LE |
| 4,259,172 | 3/1981 | Liotta | 208/8 LE |
| 4,406,663 | 9/1983 | Baldwin | 208/8 LE |

FOREIGN PATENT DOCUMENTS

| | | | |
|---|---|---|---|
| 53-0045307 | 4/1978 | Japan | 44/51 |

*Primary Examiner*—William R. Dixon, Jr.
*Assistant Examiner*—Margaret B. Medley
*Attorney, Agent, or Firm*—Robert A. Kulason; James J. O'Loughlin; Carl G. Seutter

[57] ABSTRACT

The problem of creaming during formation of disperse-slurry of coal liquefaction residue by ball milling with water is eliminated by use, as an anti-creaming additive, of a quaternary amine such as tallow trimethyl ammonium chloride.

18 Claims, No Drawings

FORMATION OF DISPERSE-SLURRY OF COAL LIQUEFACTION RESIDUE

FIELD OF THE INVENTION

This invention relates to the formation of a disperse-slurry of coal liquefaction residue in aqueous medium characterized by elimination of creaming.

BACKGROUND OF THE INVENTION

As is well known to those skilled in the art, solid carbonaceous materials including coals of high and low rank, may be subjected to various processes to convert at least a portion of the carbon present in the solid to a liquid form; and these processes for hydrogenation of coal are commonly termed coal liquefaction processes.

In these processes, finely powdered coal, typically of size such that at least 100 w% passses through a 40 mesh US Standard sieve is contacted (in the form of a slurry) with hydrogen at 350° C.-600° C., say 450° C. and 1000-2500 psig, say 2000 psig to form hydrocarbons characterized by increased hydrogen content. Illustrative of processes for upgrading coal are those disclosed in U.S. Pat. No. 2,221,886, U.S. Pat. No. 2,860,101, and U.S. Pat. No. 3,341,447.

Product hydrocarbon liquids are separated by distillation leaving an extremely hydrophobic solid typically characterized as follows:

TABLE

| Property | Value |
|---|---|
| carbon (w %) | 65.2 |
| density g/cc | 1.44 |
| boiling point | above 700° C. |
| melting point | 200-300° C. |
| ash (w %) | 27.85 |
| particle size mean | 71.4 microns |
| range | 30-220 microns |

It is desirable to use this coal liquefaction residue as a charge to a gasification reaction i.e. to convert it to a synthesis gas (containing carbon monoxide and hydrogen) by partial combustion; but this has proven to be difficult because of the problems encountered during feed preparation. The synthetic coal liquefaction is a composition which has properties totally unlike other carbonaceous materials; and these render it particularly and uniquely difficult to handle.

It is found that if coal liquefaction residue be subjected to grinding and mixing with water in an attempt to form a slurry suitable for use as feed to gasification, the slurry is characterized by problems, the principal one of which is creaming.

Creaming, as the term is used in this specification, refers to the separation of phases in a system containing an aqueous medium and a finely divided hydrophobic solid medium, the latter forming a supernatant phase above a large body of liquid containing solids.

Creaming is distinguished from other phenomena which may be present in two phase systems including the following:

(i) Foaming refers to the formation of a gas-liquid mixture of low density adjacent to the surface of a lower body which may for example be a uniform mixture of liquids and solids. A foam is characterized by the presence of a large proportion of gas phase and very little (usually no) solid phase; by a low density; and by the fact that it may frequently be eliminated or minimized by addition of agents which lower the surface tension of the liquid component of the foam. Elimination of foaming does not per se mean elimination of creaming.

(ii) Emulsification refers to the formation of a mixture of particles of one liquid with a second liquid. In commercial practice, one liquid is invariably water and the other is an oil. Thus the two common types of emulsions are oil-in-water (O/W) and water-in-oil (W/O). In certain instances the presence of solid particles may stabilize emulsions by collecting at the oil-water interface and armoring the phase for which the solid has greater affinity. Addition of surface-active agents can enhance or destroy the stability of the emulsion, but it has no effect on the creaming phenomenon.

It is particularly to be noted that procedures which solve other problems do not necessarily solve the problem of creaming. For example, it is possible to utilize a system which provides satisfactory emulsifying or dispersing properties but which fails to solve the problem of creaming.

It is an object of this invention to provide a process for eliminating creaming in a disperse slurry of coal liquefaction residue in aqueous medium. Other objects will be apparent to those skilled in the art.

STATEMENT OF THE INVENTION

In accordance with certain of its aspects, this invention is directed to a process for forming a disperse-slurry in aqueous medium of particles of a hydrophobic coal liquefaction residue containing phenolic components which are conducive to creaming which comprises contacting said hydrophobic H-coal residue, containing phenolic components which are conducive to creaming, with a cationic surfactant $R^1R^2R^3R^4N^+N^-$ wherein $R^1$ is a $C_{12}$-$C_{20}$ hydrocarbon group; each of $R^2$, $R^3$ and $R^4$ is a $C_1$-$C_6$ lower hydrocarbon groups or a poly(oxyalkalene) group having 12-25 repeating units; and X is an inert anion such as a halide whereby said surfactant is adsorbed onto said particles; and Comminuting, in the presence of aqueous medium, said hydrophobic residue, containing phenolic components which are conducive to creaming, in the presence of said surfactant thereby forming a slurry of comminuted hydrophobic H-coal residue in aqueous medium characterized by decreased creaming, enhanced dispersability, decreased wall adhesion, and reduced phase separation; and recovering said slurry of comminuted hydrophobic residue in aqueous medium characterized by decreased creaming, enhanced dispersability, decreased wall adhesion, and reduced phase separation.

DESCRIPTION OF THE INVENTION

The charge particles of coal liquefaction residue which may be treated by the of this invention are typically those attained as by-product from coal liquefaction processes. This charge residue is preferably finely divided to a particle size such that at least about 70 w% passes through 60 mesh (US Standard) sieve. Preferably 100 w% passes through a 40 mesh sieve and 0 w% passes through a 400 mesh sieve. Commonly 90-100 w% passes through a 40 mesh sieve and 80-90 w% is retained on a 400 mesh sieve. It may be considered as having a 40-400 mesh particle size. Alternatively expressed, it may have a range of particle size of 30-220 microns and a typical mean particle size of about 71 microns.

These charge particles are mixed with a process-derived liquid, typically having an ibp of greater than 100° C., commonly 150° C.-300° C., say 230° C. This liquid may have a density of 0.70-1.10, day 0.85.

The particles (100 parts) are commonly mixed with 200-300-parts, say 230 parts of process-derived liquid and hydrogenated at 350° C.-600° F., say 450° C. and 1000-2500 psig, say 2000 psig partial pressure of hydrogen for 30-120 minutes, say 60 minutes in liquid phase in the presence of catalyst. The catalyst, maintained in a liquid phase ebullient bed hydrocracker, may preferably be 0.01-10 nanometers, say 0.5 nanometer particles of (i) silica-promoted cobalt molybate, (ii) molten zinc chloride, etc.

Effluent from coal liquefaction treating may be subjected to various processing steps to permit recovery of (i) desired liquids including process-derived liquid and a (ii) solid hydrophobic residue the solid being characterized by the following properties:

TABLE

| Property | Value | Preferred |
|---|---|---|
| w % carbon | 10%-80% | 65.2 |
| density g/cc | 1.2-1.5 | 1.4 |
| boiling point (°C.) | above 700 | above 700 |
| melting point (°C.) | 200-300 | 260 |
| particle size (microns) | 20-1000 | 30-220 |
| phenolic compounds w % | 2-10 | 5 |

In order to utilize this residue in a synthesis gas generation operation, it is desired to form a disperse slurry in aqueous medium. Aqueous medium may be fresh water or recycle water from the process or any aqueous medium which is available at the unit and which is free of undesirable components.

In practice of the process of this invention, one part of the hydrophobic residue containing undesirable phenolic components, is contacted (in the presence of 1-200 parts, say 100 parts, of water) with 0.001-0.1 parts, preferably 0.01-0.1 parts, say 0.1 parts of as additive a cationic surfactant $R^1R^2R^3R^4N^+X^-$ wherein $R^1$ is a $C_{12}$-$C_{20}$ hydrocarbon group; each of $R^2$, $R^3$ and $R^4$ is a $C_1$-$C_6$ lower hydrocarbon groups or a poly oxyalkylene group, and X is an inert anion such as a halide.

In the above formula, $R^1$ is typically a $C_{12}$-$C_{20}$ hydrocarbon group including alkyl or alkenyl groups. Preferred of these are straight chain alkyl hydrocarbon groups including $C_{12}$, $C_{14}$, $C_{16}$ etc groups. Preferred may be commercially available groups, containing mixtures of naturally occuring groups, typically tallow (containing principally $C_{16}$ palmitic, $C_{18}$ stearic, and $C_{18}$ oleic residues); or coco (containing principally $C_{12}$ lauric, $C_{14}$ myristic, and $C_{16}$ *l palmitic residues) etc.*

$R^2$, $R^3$ and $R^4$ may be (i) $C_1$-$C_6$ lower hydrocarbon groups typified by alkyl or alkenyl etc. or (ii) a poly(oxyalkylene) group such as the poly(oxyethylene) group $(C_2H_4O)_n$ wherein n is 12-25. Typically $R^2$, $R^3$ or $R^4$ may be methyl, ethyl, propyl, isopropyl, n-butyl, isobutyl, t-butyl, etc. When $R^2$ or $R^3$ or $R^4$ is a poly(oxyethylene) group, it may typically be $(C_2H_4O)_{15}$.

X is preferably a water-soluble anion typified by halide—preferably chloride or bromide.

Typical of the quaternary additives which may be employed may be the following:

TABLE

| | | | |
|---|---|---|---|
| Hexadecyl | trimethyl | ammonium | bromide |
| Tetradecyl | trimethyl | ammonium | bromide |
| Coco | trimethyl | ammonium | chloride |
| Dicoco | dimethyl | ammonium | chloride |
| Dihexadecyl | dimethyl | ammonium | chloride |
| Poly (oxyethylene) (12) hexadecyl dimethyl ammonium chloride | | | |
| Poly (oxyethylene) (12) octadecyl dimethyl ammonium chloride | | | |
| Poly (oxyethylene) (15) octadecyl dimethyl ammonium chloride | | | |

It is preferred that the additive (in amount of 0.001-0.1, say 0.1 parts) be added to the residue (one part) and mixed together with 1-200, typically 1-100 parts, say 50 parts of aqueous liquor at 10°-40° C., say 25° C. and the mixture be allowed to sit for 10-45 minutes, say 30 minutes during which period, the additive soaks into the residue as the mixture is maintained quiescent.

At the end of the soaking period, there is added 25-100 parts, say 50 parts of additional aqueous liquor, making in all 50-200 parts, say 100 parts of aqueous liquor. The additive is thus present in amount of 0.1-10 w%, preferably 0.1-1, say 0.1 w% of the residue.

The mixture is then comminuted under shear conditions. Preferably wet grinding is effected in a ball mill, although it may be possible to effect comminution with shearing in other equipment typified by (i) a Rod Mill, (ii) a Raymond Mill or an (iii) ultrasonic mill.

As ball milling is carried out in the preferred embodiment over 60-960 minutes, say 480 minutes, the slurry of residue in aqueous medium is gradually homogenized as the residue is reduced in particle size during shearing and becomes dispersed within the aqueous medium.

It is a feature of the process of this invention that use of the additives noted permits attainment of advantages not attained by use of other additives. Among these advantages may be noted decreased creaming.

It is commonly found that the tendency of the mix to cream is substantially decreased. Presence of the additive of the process of this invention permits attainment of the desired disperse-slurry with minimum creasing.

The product ball milled mixture which typically contains 1 part of residue per 50-200 parts, say 100 parts of liquid and 0.001-0.1 parts, say 0.1 part of additive is found to be of suitable properties including stability so that it may be serve as charge to a unit for preparing synthesis gas—as in disclosed for example in U.S. Pat. No. 2,818,326 to Texaco as assignee of Eastman.

DESCRIPTION OF PREFERRED EMBODIMENTS

Practice of the process of this invention according to its preferred aspects will be apparent to those skilled in the art from the following wherein as elsewhere in this specification, all parts are parts by weight unless otherwise specified.

EXAMPLE I

In this example which represents the best mode presently known of practicing the process of this invention, the charge material is one part of a ground coal liquefaction residue, a coal liquefaction residues, having the following properties:

| Property | Value |
|---|---|
| Elemental Analysis w % | |
| C | 65.2 |
| H | 8.58 |
| N | 1.18 |
| S | 2.50 |

-continued

| Property | Value |
|---|---|
| Ash | 27.85 |
| Heating Value (BTU/#) | 13,500 |
| Particle Size (microns) | |
| Mean | 71.4 |
| Range | 30–220 |
| Density (g/ml) | 1.44 |
| Zeta Potential (mv) | −13.5 |

To this charge material (one part) there is added 0.01 parts of the Arquad T-50 brand of tallow trimethyl ammonium chloride. (Tallow is a commercially available fatty acid moiety containing principally residues of palmitic ($C_{16}$), stearic ($C_{18}$) and oleic ($C_{18}$) acids) in 100 parts of distilled water. This mixture in a stopped 100 ml graduated cylinder was inverted twice; and observations were made at five minute intervals for one hour. Results were measured in terms of (i) percent of creamed layer present and (ii) percent of settled residue. Desirably the results show a high % dispersed after sixty minutes and a low % creamed after sixty minutes.

In similar runs, the amounts of tallow trimethyl ammonium chloride were 0.1 parts and 1 part corresponding to 0.1 w% and 1 w% based on the solid charge.

EXAMPLES II–VI

In these examples, the following quaternary surfactants were employed:

| Example | Surfactant |
|---|---|
| II | Coco trimethyl ammonium chloride (Arquad C-50 brand) |
| III | Di-coco dimethyl ammonium chloride (Arquad 2C-75 brand) |
| IV | Tetradecyl trimethyl ammonium chloride |
| V | Hexadecyl trimethyl ammonium chloride |
| VI | Poly (oxyethylene) (12) octadecyl dimethyl ammonium chloride (Ethoquad 18/75 brand |

The amount of surfactant was 0.01 w% or 0.1 w% or 1 w% of the solid.

The results were as follows:

TABLE

| Surfactant Example | Concentration wt % | % Dispersed After 60 min. | % Creaming After 60 min. |
|---|---|---|---|
| I | 1 | 100 | 0 |
| | .1 | 100 | 0 |
| | .01 | 0 | 100 |
| II | 1 | 100 | 0 |
| | .01 | 100 | 0 |
| | .01 | 0 | 100 |
| III | 1 | 100 | 0 |
| | .1 | 100 | 0 |
| | .01 | 10 | 90 |
| IV | 1 | 100 | 0 |
| | .1 | 100 | 0 |
| | .01 | 0 | 100 |
| V | 1 | 100 | 0 |
| | .1 | 100 | 0 |
| | .01 | 0 | 100 |
| VI | 1 | 100 | 0 |
| | .1 | 100 | 0 |
| | .01 | 10 | 90 |

From the above table, it is clear that, at concentrations at or above 0.1 w%, it is possible to achieve both good wetting and dispersibility; creaming may be kept to a minimum and in most instances eliminated.

EXAMPLE VII–XI

In this series of Examples, various surfactants were tested at 1 w% concentrations in a similar test. (An asterisk designates a control example falling outside the scope of this invention).

TABLE

| Example | Surfactant | Concentration (%) | % Creaming After 30 min. | % Dispersed After 30 min. |
|---|---|---|---|---|
| VII* | Na+ dodecyl benzene sulfonate | 1% | 95% | 95 |
| VIII* | Nonyl phenoxy polyethoxy (5) ethanol | 1% | 100% | 0% |
| IX* | Poly ethylene ether of linear dodecyl alcohol | 1% | 0% | 0% |
| X | Hexadecyl trimethyl ammonium chloride | 1% | 0% | 100% |
| XI | Tallow trimethyl ammonium chloride | 1% | 0% | 100% |

From this table, it is apparent that the control compositions of Examples VII* and VIII* did not eliminate creaming and that the control compositions of Example IX* did not yield dispersions. Only the experimental compositions of Examples X and XI, falling within the scope of this invention, eliminated creaming and yielded satisfactory dispersion.

EXAMPLES XII*–XXIII*

In a comparable series of examples, the following surface-active agents were found to be ineffective at the one w% level, in that they did not decrease creaming nor did they provide satisfactory dispersion.

TABLE

| Example | Agent |
|---|---|
| | Metal Alkyl arylsulfonates typified by: |
| XII* | The Alkanol XC brand of alkyl ($C_3$–$C_4$) naphthalene sulfonate, sodium salt |
| XIII* | The Alkanol DW brand of alkyl ($C_{10}$–$C_{12}$) phenyl sulfonate, sodium salt |
| XIV* | The Conoco AAS-60S brand of dodecylbenzene sulfonate, ammonium salt |
| XV* | The Alkanol 189-S brand of $C_{12}$–$C_{14}$ alkyl hydrocarbon benzene sulfonate, sodium salt |
| XVI* | The Alkanol ND brand of isopropyl dinaphthalenic sulfonate, sodium salt |
| | Lignin sulfonates typified by: |
| XVII* | The Orzan A brand of ammonium lignin sulfonate |
| XVIII* | The Orzan S brand of sodium lignin sulfonate |
| XIX* | The Petro dispersant 425 brand of saturated polymeric lignin sulfonate |
| | Hydrocarbon phosphate acid esters typified by: |
| XX* | The Tryfac 5576 brand of phosphated poly-oxyethylenated long chain alcohols and phenols |
| XXI* | The Concofac 610 brand of |

TABLE-continued

| Example | Agent |
|---|---|
| | phosphated poly-oxyethylenated long chain alcohols and phenols |
| | Sodium Alkyl sulfates typified by: |
| XXII* | The Alipal CO-433 brand of nonyl phenoxy poly (ethoxy) (5) sulfate |
| XXIII* | The Sipex OLS brand of sodium octyl sulfate |
| XXIV* | The Duponol OC brand of sodium dodecyl sulfate |
| | Polyethoxylated Alkylphenols typified by: |
| XXV* | The Triton N-57 brand of nonylphenoxy poly (oxyethylene) (5) ethanol |
| XXVII* | The Neutronyx brand of alkyl ($C_2$–$C_4$) phenol polyglycol ether |
| XXVIII* | The Alkasurf OP-10 brand of octylphenol ethoxylate. |

The following surfactants were identified as being effective wetting agents but poor dispersants:

TABLE

| | |
|---|---|
| | Petroleum sulfonates typified by: |
| XXIX* | The Ultrawet brand of sodium linear alkyl ($C_4$–$C_6$) sulfonate |
| XXX* | The Petronate L brand of sodium petroleum ($C_{14}$–$C_{18}$) sulfonate |
| | Poly (ethoxylated) Poly (propoxylated) glycols typified by: |
| XXXI* | The Tergitol 25-L12 brand of polyethylene (25) glycol ether of $C_{12}$ primary alcohol |
| XXXII* | The Tergitol 15-S3 brand of polyethylene (15) glycol ether of $C_3$ secondary alcohol |
| | Sulfosuccinate Esters typified by: |
| XXXIII* | The Aerosol OT brand of sodium dioctyl sulfosuccinate |

In each of these control examples, it was noted that there was an undesirably large cream layer and the dispersion was undesirably low.

EXAMPLES

In this series of examples, XXXIV–XXXVI the quaternary compositions of Examples III and VI were tested to determine their effect on the rheological behavior of the slurry. Specifically varying amounts of solid were added to water to determine the maximum concentration of the pumpable slurry which could be obtained by use of 1 w% of additive.

TABLE

| Example | Quaternary from Example | Maximum Pumpable Slurry Concentration w % |
|---|---|---|
| XXXIV | III | 62.8 |
| XXXV | VI | 62.9 |
| XXXVI* | none | 62.8 |

From these examples, it is apparent that the additives of this invention desirably have no negative impact on the rheological properties of the slurry.

Although this invention has been illustrated by reference to specific embodiments, it will be apparent to those skilled in the art that various changes and modifications may be made which clearly fall within the scope of this invention.

What is claimed is:

1. The process for forming a disperse-slurry in aqueous medium of comminuted particles of a hydrophobic coal liquefaction residue containing phenolic components which are conducive to creaming which comprises contacting said hydrophobic H-coal residue, containing phenolic components which are conducive to creaming, with 0.001–0.1 parts per 100 parts of aqueous medium of a cationic surfactant $R^1R^2R^3R^4N^+X^-$ wherein $R^1$ is a $C_{12}$–$C_{20}$ hydrocarbon group; each of $R^2$, $R^3$ and $R^4$ is a $C_1$–$C_6$ lower hydrocarbon group or a poly(oxyalkylene) group having 12–25 repeating units; and X is an inert anion whereby said surfactant is adsorbed onto said particles; and comminuting, in the presence of aqueous medium, said hydrophobic coal liquefaction residue, containing phenolic components which are conducive to creaming, in the presence of said surfactant thereby forming a slurry of comminuted hydrophobic coal liquefaction residue in aqueous medium characterized by decreased creaming decreased wall adhesion, and reduced phase separation; and recovering said slurry of comminuted hydrophobic coal liquefaction residue in aqueous medium characterized by decreased creaming, enhanced dispersability, decreased wall adhesion, and reduced phase separation.

2. The process for forming a disperse-slurry as claimed in claim 1 wherein said $R^1$ group is derived from tallow.

3. The process for forming a disperse-slurry as claimed in claim 1 wherein said $R^1$ groups is derived from coco.

4. The process for forming a disperse-slurry as claimed in claim 1 wherein said $R^1$ group is tetradecyl.

5. The process for forming a disperse-slurry as claimed in claim 1 wherein said $R^1$ group is hexadecyl.

6. The process for forming a disperse-slurry as claimed in claim 1 wherein said $R^2$, $R^3$ and $R^4$ groups are lower alkyl groups.

7. The process for forming a disperse-slurry as claimed in claim 1 wherein said $R^2$, $R^3$ and $R^4$ groups are methyl groups.

8. The process for forming a disperse-slurry as claimed in claim 1 wherein at least one of said $R^2$, $R^3$ and $R^4$ groups is a poly(oxyalkylene) group.

9. The process for forming a disperse-slurry as claimed in claim 1 wherein at least one of said $R^2$, $R^3$ and $R^4$ groups is a poly(oxyethylene) group.

10. The process for forming a disperse-slurry as claimed in claim 1 wherein X is a halide.

11. The process for forming a disperse-slurry as claimed in claim 1 wherein X is chloride or bromide.

12. The process for forming a disperse-slurry as claimed in claim 1 wherein said surfactant is tallow trimethyl ammonium chloride.

13. The process for forming a disperse-slurry as claimed in claim 1 wherein said surfactant is coco trimethyl ammonium chloride.

14. The process for forming a disperse-slurry as claimed in claim 1 wherein said surfactant is tetradecyl trimethyl ammonium chloride.

15. The process for forming a disperse-slurry as claimed in claim 1 wherein said surfactant is hexadecyl trimethyl ammonium chloride.

16. The process for forming a disperse-slurry as claimed in claim 1 wherein said surfactant is poly(oxyethylene) (12) octadecyl dimethyl ammonium chloride.

17. The process for forming a disperse-slurry in aqueous medium of 40–400 mesh particles of a hydrophobic coal liquefaction residue containing phenolic components which are conducive to creaming which comprises contacting one part of coal liquefaction residue with 0.1–1 part of tallow trimethyl ammonium chloride surfactant;

comminuting, in the presence of 50–200 parts of aqueous medium, said coal liquefaction residue and said surfactant thereby forming a slurry of comminuted hydrophobic coal liquefaction residue in aqueous medium characterized by decreased creaming, enhanced disperability, decreased wall adhesion, and reduced phase separation; and recovering said slurry of comminuted hydrophobic coal liquefaction residue in aqueous medium characterized by decreased creaming, enhanced dispersability, decreased wall adhesion, and reduced phase separation.

18. A disperse-slurry in aqueous medium comprising one part of 40–400 mesh particles of a hydrophobic coal liquefaction residue containing phenolic components which are conducive to creaming;

0.1–1 part of a cationic surfactant $R^1R^2R^3R^4N^+X^-$ wherein $R^1$ is a $C_{12}$–$C_{20}$ hydrocarbon group; each of $R^2$, $R^3$ and $R^4$ is a $C_1$–$C_6$ lower hydrocarbon group or a poly(oxyalkylene) group having 12–25 repeating unit; and X is a halide; and 50–200 parts of aqueous medium, said disperse-slurry being characterized by decreased creaming, enhanced dispersability, decreased wall adhesion, and reduced phase separation.

* * * * *